US008444294B1

(12) United States Patent
Hawkins

(10) Patent No.: US 8,444,294 B1
(45) Date of Patent: May 21, 2013

(54) ILLUMINATED DOORMAT

(76) Inventor: Victor Jonathan Hawkins, Castle Rock, CO (US)

( * ) Notice: Subject to any disclaimer, the term of this patent is extended or adjusted under 35 U.S.C. 154(b) by 513 days.

(21) Appl. No.: 12/655,654

(22) Filed: Jan. 4, 2010

Related U.S. Application Data

(63) Continuation-in-part of application No. 12/290,360, filed on Oct. 29, 2008, now Pat. No. 7,670,026.

(51) Int. Cl.
*F21V 33/00* (2006.01)

(52) U.S. Cl.
USPC ..... 362/234; 362/100; 362/153; 362/249.05; 362/253; 362/276

(58) Field of Classification Search
USPC ..... 362/100, 153, 234, 249.02, 249.05, 362/253, 276, 802
See application file for complete search history.

(56) References Cited

U.S. PATENT DOCUMENTS 4,544,993 A * 10/1985 Kirk ..... 362/153
5,019,950 A * 5/1991 Johnson ..... 362/153
5,848,830 A * 12/1998 Castle et al. ..... 362/802
7,682,034 B2 * 3/2010 Asvadi et al. ..... 362/103

* cited by examiner

*Primary Examiner* — Stephen F Husar
(74) *Attorney, Agent, or Firm* — Risto A. Rinne, Jr.

(57) ABSTRACT

An apparatus for providing illumination includes a lower underlying layer that is attached to an upper surface layer. The upper surface layer includes any desired material that can be stepped on and used as the upper surface of a doormat. The underlying layer includes circuitry and wiring for conveying electrical energy from a battery to at least one light attached to the apparatus upon the activation of a sensor sufficient to illuminate the light, a portion of the upper surface layer, and a portion of the area disposed above the upper surface layer. A plurality of light emitting diodes are the preferred type of the light. An optional timer and other optional components and features are discussed. Various types of construction are described depending on whether the underlying layer is opaque or transparent or if a prior art type of doormat is to be included as a component of the apparatus.

15 Claims, 3 Drawing Sheets

ILLUMINATED DOORMAT

This application is a Continuation-In-Part of patent application Ser. No. 12/290,360, now U.S. Pat. No. 7,670,026 that was filed on Oct. 29, 2008 by the same inventor, entitled Night-light Rug, and which claims the benefit of priority of the date of U.S. Pat. No. 7,670,026, and wherein the specification and teachings of U.S. Pat. No. 7,670,026 are included herein, by reference.

BACKGROUND OF THE INVENTION

1. Field of the Invention

The present invention, in general, relates to doormats and, more particularly, to an illuminated doormat that can be used outdoors.

A definition of a mat as found in "dictionary.com" is, "a protective covering on a floor or other surface" that is made of a pliant material. Another definition of a mat from the same location is, "A flat piece of coarse fabric or other material used for wiping one's shoes or feet, or in various other forms as a floor covering." Webster's New World College Dictionary also includes as a definition of a mat a, "removable floor covering for a car."

If coarser fibers such as hemp, cocoa fiber, or other types of fibers or filaments are embedded in a rubber or other elastomeric or other base layer, the floor covering is typically referred to as a doormat. Such types of doormats are intended to provide a surface upon which one may wipe and thereby clean their shoes, usually before entering a building. The ability to clean shoes and certain other benefits which may be provided by use of a doormat are also briefly noted, hereinafter.

A doormat, as used herein, is typically placed in close proximity to a door that provides access into a house, apartment, condominium or the doormat is placed in close proximity to a door that provides access into any other type of residence. Alternately, the doormat is often placed in close proximity to a door that provides access into a retail, commercial, wholesale, government, public-use, private-use building, office, store, or other type of structure.

Often, the exterior location is by a type of exterior door that is a threshold between an area located outside the structure (i.e., outdoors) and an area located inside the structure. Accordingly, the doormat must be able to tolerate the year-round variations in weather and outside environment that are likely to occur where the doormat is used.

On occasion, the exterior location where the doormat is placed may include a threshold between an entry point into a retail store or office location (or other area) and a common hallway that is shared by other stores or by other offices that are disposed in the same structure. For example, a doormat may be placed at the entrance door of a store in a shopping mall. The most common location for the placement of most doormats is proximate a front door entrance and/or a back-door entrance of any type of a residence.

A doormat typically serves two primary purposes. First, it provides a surface that can be used to remove debris or dirt from the bottom of a person's shoes before entering the (interior) area. Second, the use of a doormat can enhance the aesthetics of the entryway by providing an accent color, appearance, message, or it can provide a contrasting and complimentary color or appearance with respect to the entryway.

As desired, doormats can be further customized and/or personalized to include any desired ornamental overall shape, or decorative image, written communication, logo or pattern.

If desired, a doormat can be used in locations that are not proximate an entrance door if any of the benefits that the doormat is capable of providing are desired for use at the other locations. Therefore, the illuminated doormat, while primarily intended for use proximate an entrance, can also be used wherever it is desired.

Most entrance doors are locked when the resident, proprietor, manager, occupant, employee, or owner is away. Upon approach, the entrance door must first be unlocked to gain entry into the structure or into an area that is disposed within the structure. The user must locate the desired key, often by having to locate the desired key apart from other similarly sized and shaped keys, separate the desired key for use, correctly orient the desired key for insertion into a key opening of a door lock, ascertain the location of the key opening in the door lock, and then insert the desired key in the key opening before the user can unlock the door lock and gain entry.

If the area is dark or dimly lit, the user may try repeatedly in vain to insert the wrong key into the key opening before realizing their mistake. This wastes time and can cause frustration. The user may be unable to locate the proper key when they are by the entrance door. Accordingly, the user may have to retreat to an area that is better illuminated in order to locate the proper key and then return again to the dimly lit area by the entrance door. Upon returning to the entrance door, the user may continue to struggle as he or she attempts to locate the key opening, properly orient the key (i.e., determine which side of the key should face upward) with respect to the key opening, insert the key in the key opening, and unlock the door.

To help solve this problem, outside sources of illumination have previously been utilized, however, these solutions are not without their own disadvantages. For example, the user may simply neglect (forget) to turn on an outside light when leaving. The user may prefer to not leave the premises vacant with an outside light that is constantly illuminated, lest it act as a beacon to potential burglars informing the burglars whenever the residence (or other type of location) is vacant.

Exterior flood or general illumination lighting with motion sensors and timers may provide additional benefits, however, they often turn on when not desired. For example, when cats or dogs or other wild nocturnal animals, like skunks and raccoons, pass within the field of the motion sensor the outside illumination will automatically turn on and remain illuminated for a period of time.

The sudden, unexpected illumination of outside sources of illumination during the night can cause residents and even their neighbors to awaken. Many residents have complained to their neighbors about the annoyance caused by their motion-sensor activated outside lights that illuminate frequently during the night.

It is also important to note that some people may experience fear upon awakening under these conditions at the thought that someone unwanted is, perhaps, attempting to gain forced entry into their home or residence. Also, there are instances where residents or business proprietors are prohibited from installing sources of external illumination at locations they do not own because of restrictions affecting construction or modifications to the structure that are specified in the lease agreement.

Furthermore, the most common types of bulbs used in all exterior lighting sources eventually fail and may be unavailable when needed. Incandescent bulbs have a relatively short life compared to fluorescent bulbs, however, even fluorescent bulbs will typically fail after a few thousand hours of use.

Additionally, being disposed outside shortens the life expectancy of most bulbs. Temperature extremes can damage incandescent or fluorescent bulbs. Cold exterior temperatures can cause a damaging surge current to occur on power-on that can instantly destroy the incandescent bulb's filament, regardless of the number of hours of illumination that have been provided by the bulb. Sufficiently cold outside temperatures may prevent illumination of fluorescent lights from occurring.

Accordingly, there is a need for a reliable source of illumination proximate an entrance door that provides illumination when desired and where desired and which helps to ameliorate the above-mentioned problems and difficulties.

While a limited variety of illuminated throw rugs are known, they have various problems that are inherent with their designs. For example, certain prior art devices include a central light source with fiber optic elements that radiate and protrude upward through the surface of the rug. This type of a design poses a risk of a user being cut by the fine fiber optic filaments that protrude. The feet are certainly at risk as would be any part of the anatomy that came in contact with such filaments. For example, a baby that was crawling on such a device would be at risk of puncturing the skin at any contact point including the face and eyes. Accordingly, they would not be effective for use as an illuminated doormat.

Additionally, there is little dispersion of light that occurs after the light has left the fiber optic filaments. Therefore, in order to see the light one must be disposed in a position that generally is directly above the mat in order to see any appreciable light. This type of a design is largely ineffective at illuminating a larger area for practical purposes and is seen as a low durability novelty type of device.

Certain other prior art devices include an on-off switch that must be located and which can draw power and remain illuminated when it is not needed. It can be difficult to locate the on-off switch in the dark. Additionally, they are not intended for exterior use out of doors.

Certain other prior art devices may or may not include a transformer and require connection to a 120 VAC source of electrical power. Accordingly, they require an electrical wire from the 120 VAC source that leads to the device which can pose a tripping hazard. As entrance doors to residences are typically elevated above a surrounding grade level and, thereby of necessity, often include one or more steps or series of stairs nearby, the risk of engaging with and tripping caused by an interconnecting wire of the device when leaving a residence, for example, creates a significant potential liability issue.

Additionally, the need for a 120 VAC outlet limits the options for placement of such types of devices. Also, a considerably elevated risk of electrocution may occur if a malfunction occurs whenever 120 VAC wiring is present, and especially so if 120 VAC is used outdoors and in potentially wet areas. Also, cats, dogs, or other pets may chew the wire and risk electrocution or harm. Unattended children may play with the wire, possibly exposing the conductor within, and similarly risk electrocution or harm.

Similarly, prior art devices that use motion sensors must maintain power to the motion sensor which would prematurely drain any battery-operated type of device. Accordingly, if a motion sensor is used the device must in some way be connected to a 120 VAC source of electrical power.

A prior art device, as offered for sale in a 2008 Hammacher Schlemmer Holiday Preview catalog on page 49 uses wireless activation of remote lights when a person stands on an elevated foot mat. Such a design is difficult to activate and it provides a narrowly directed field of illumination that is not generally useful. The prior art device is also especially high and can pose a significant tripping hazard. Therefore, it is not well-suited for placement on a floor in a center of a room and is better suited for placement against a wall, bed, or other object. It also detracts from the room's aesthetics. Accordingly, it has appeal to only a limited number of users such as by senior citizens and is generally lacking in appeal to more youthful buyers or those seeking to augment the aesthetics of an area. Additionally, it is not intended or suitable for use outside and, as such, cannot in anyway be used as a doormat, either at an interior or exterior door location.

There is a need for a device that functions as a doormat and which is self-contained and receives electrical power, preferably, from one or more preferably replaceable batteries. There is a need that such a type of device should conserve battery power by remaining in a quiescent state in which the illumination is off until it is stepped on by a user and which remains illuminated for a predetermined period of time after being stepped on, or which remains illuminated for the predetermined period of time and shuts off upon the conclusion of the predetermined period of time unless the user steps off of the device and again back on the device during the predetermined period of time, in which case the device turns off the moment that it is stepped on for the second time or, alternately, there is a need for a device that is off (i.e., not illuminated and in the quiescent state) whenever the device is not being stepped on and which turns on (i.e., enters an active state) and remains illuminated whenever the device is being stepped on, and which turns off (i.e., reenters the quiescent state) the moment the user steps off of the device.

There is a need for a device that provides illumination and which is attractive in appearance or which can be used to provide an ornamental design that accents an entrance area, which provides a written or audible message or instruction such as "Welcome" or "Use Backdoor for Deliveries", or which resonates with any topic of interest, sport, or hobby of a user.

Additionally, there is a need for a device that does not include any protruding lights or other protruding source of illumination that extends beyond the device itself and which can impact a user if contacted by the user, or which might cause harm or injury if contacted.

Additionally, there is a need for a device that does not include any exposed wires that could pose a tripping hazard or source of electrical shock, harm, or electrocution.

There is a need for a device that can provide illumination where desired, for example, by an exterior door.

Other potential areas of increased utility may include placement proximate to an access or entry location leading into boats and recreational vehicles (RVs), for seasonal or holiday use, or for use as a utility doormat that can be used by entrances leading into garages, workshops, sheds, or other areas to provide ready and instant illumination upon the arrival or approach of a person or, stated in other words, exactly when and where the illumination is needed.

There is also a need for a placement of an illuminated doormat that supports a theme that is being expressed or echoed by a design on the doormat. For example, the source of illumination can, in certain applications, be used to enhance the visual appearance or ease of detection of an object, design, artwork, logo, message or instruction that is included on the doormat.

There is also a need for a similar placement of illumination sources on a doormat in a manner that supports or enhances a character theme, such as DISNEY™ characters, comic book characters, or characters, whether fictitious or real, that are depicted on television or in motion pictures (i.e., movies).

There is also, preferably, a need to ensure that access for replacing batteries or varying settings (if included) can be accomplished.

There is also a need for a doormat that provides illumination without the effort of having to search for a wall or appliance switch.

A popular type of construction used with doormats includes any preferred type of fiber (or strand material) that is used to form an upper surface of the doormat and with a lower portion of the fibers embedded into and, thereby, secured by a type of underlying layer. The underlying layer typically includes a layer of rubber or other elastomeric material although any suitable material may be used. Any desired type of fiber, thread, strands, or other material, either naturally occurring or synthetic, can similarly be used for the upper surface (or fiber portion). A currently popular type of material used for the fiber includes the use of coconut fiber and, when used, the doormat is generally referred to as a "coir mat".

Accordingly, there exists today a need for an illuminated doormat that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

Clearly, such an apparatus would be a useful and desirable device.

2. Description of Prior Art

Illuminated devices are, in general, known. For example, the following patents describe various types of these devices, some of which may have relevance as well as others which may not have particular relevance to the invention. These patents are cited not as an admission of their having any particular relevance to the invention but rather to present a broad understanding of the current state of the art appertaining to either the field of the Invention or possibly to other related or distal fields of invention.

U.S. Pat. No. 7,358,861 to Blum et al., that issued on Apr. 15, 2008;

U.S. Pat. No. 6,718,576 to Shih, that issued on Apr. 13, 2004;

U.S. Pat. No. 5,848,830 to Castle et al., that issued on Dec. 15, 1998;

U.S. Pat. No. 5,019,950 to Johnson, that issued on May 28, 1991;

U.S. Pat. No. 4,737,764 to Harrison, that issued on Apr. 12, 1988;

U.S. Pat. No. 4,544,993 to Kirk, that issued on Oct. 1, 1985; and including,

U.S. Patent Publication No. 2007/0258255 that published on Nov. 8, 2007.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an illuminated doormat that extends battery life because it does not draw electrical power when it is not providing illumination.

It is a continuing object of the present invention to provide an illuminated doormat that extends battery life because it does not draw any significant amount of electrical power when the doormat is not actively providing illumination.

It is also an important object of the invention to provide an illuminated doormat that turns on when it is stepped on and turns off after a period of time.

It is a continuing important object of the invention to provide an illuminated doormat that turns on when it is stepped on and turns off when it is no longer being stepped on (i.e., the moment a user steps off of the doormat).

It is a further continuing important object of the invention to provide an illuminated doormat that turns on when the doormat is jarred, moved, or otherwise impacted, and turns off after a period of time.

It is a still further continuing important object of the invention to provide an illuminated doormat that includes an inertial or motion sensor and which turns on if the doormat is jarred, moved, or otherwise impacted, and turns off after a period of time.

Another object of the invention is to provide an illuminated doormat that runs on batteries.

Still another object of the invention is to provide an illuminated doormat that includes a lower underlying layer for housing a plurality of lights, one or more batteries, control circuitry, wires, and desired types and quantity of sensors such as pressure activated switches, inertia, or motion detectors.

Still yet another object of the invention is to provide an illuminated doormat that includes at least one battery that supplies electrical power to the doormat and a lower underlying layer that allows access for replacing the battery or batteries.

Still yet another important object of the invention is to provide an illuminated doormat that uses a plurality of LED lights of any preferred color, quantity, or placement and, when preferred, white LED lights.

A first continuing object of the invention is to provide an illuminated doormat that can include any preferred overall shape, such as that of a football or other desired object, and which can include any preferred size.

A second continuing object of the invention is to provide an illuminated doormat that can provide an audible message or audible instruction upon activation.

A third continuing object of the invention is to provide an illuminated doormat that includes one or more lights that are disposed in one or more openings provided in an underlying layer where an upper end of each opening is disposed at an upper plane of the underlying layer.

A fourth continuing object of the invention is to provide an illuminated doormat that includes an underlying layer and wherein the underlying layer includes an elastomer.

A fifth continuing object of the invention is to provide an illuminated doormat that includes an underlying layer that is opaque to visible light.

A sixth continuing object of the invention is to provide an illuminated doormat that includes an underlying layer that is transparent to at least some visible light.

A seventh continuing object of the invention is to provide an illuminated doormat that can be provided in different versions and wherein the different versions can include user-selectable attributes to adjust any desired operating parameter of the illuminated doormat.

An eighth continuing object of the invention is to provide an illuminated doormat that includes an underlying layer that is formed of an elastomer, and wherein the elastomer includes a rubber or rubber-like flexible material.

A ninth continuing object of the invention is to provide an illuminated doormat that includes an underlying layer which is formed of a rigid or semi-rigid type of material, such as plastic or wood.

A tenth continuing object of the invention is to provide an illuminated doormat that includes an underlying layer which is formed of a neoprene material.

An eleventh continuing object of the invention is to provide an illuminated doormat that includes an underlying layer which is formed of a urethane material.

A twelfth continuing object of the invention is to provide an illuminated doormat that includes an underlying layer which is formed of a rubber material.

A thirteenth continuing object of the invention is to provide an illuminated doormat that includes an underlying layer which is formed of a silicone material.

A fourteenth continuing object of the invention is to provide an illuminated doormat that includes an underlying layer which is formed of a composite material.

A fifteenth continuing object of the invention is to provide an illuminated doormat that includes an underlying layer which is formed of a plastic material.

A sixteenth continuing object of the invention is to provide an illuminated doormat that includes an underlying layer which is formed of a synthetic material.

A seventeenth continuing object of the invention is to provide an illuminated doormat that includes an upper surface layer which is formed of a fiber or fibrous type of material.

An eighteenth continuing object of the invention is to provide an illuminated doormat that includes an upper surface layer which is formed of a woven type of material.

A nineteenth continuing object of the invention is to provide an illuminated doormat that includes an upper surface layer which is formed of a threaded type of material.

A twentieth continuing object of the invention is to provide an illuminated doormat that includes an upper surface layer which is formed of a material used to form a carpet.

A twenty-first continuing object of the invention is to provide an illuminated doormat that includes an upper surface layer which is formed of a synthetic material.

A twenty-second continuing object of the invention is to provide an illuminated doormat that includes an upper surface layer which is formed of a desired material, and wherein the upper surface layer includes an upper plane, and wherein the upper plane includes an upper portion of the desired material.

A twenty-third continuing object of the invention is to provide an illuminated doormat that includes an upper surface layer which is formed of a desired material, and wherein the desired material includes an upper portion and a lower portion, and wherein the lower portion of the desired material is secured to an underlying layer.

A twenty-fourth continuing object of the invention is to provide an illuminated doormat that includes an upper surface layer which is formed of a desired material, and wherein the desired material includes an upper portion and a lower portion, and wherein the lower portion of the desired material is embedded into an underlying layer and secured, thereto.

A twenty-fifth continuing object of the invention is to provide an illuminated doormat that includes a lower underlying layer that is formed of an opaque elastomeric material.

A twenty-sixth continuing object of the invention is to provide an illuminated doormat that includes a lower underlying layer that is formed of a transparent elastomeric material.

A twenty-seventh continuing object of the invention is to provide an illuminated doormat that includes a lower underlying layer that is formed of an opaque rigid or semi-rigid type of material.

A twenty-eighth continuing object of the invention is to provide an illuminated doormat that includes a lower underlying layer that is formed of a transparent rigid or semi-rigid type of material.

A twenty-ninth continuing object of the invention is to provide an illuminated doormat that is suitable for placement proximate an exterior (outside) door that provides access into a structure.

Briefly, an illuminated doormat that is constructed in accordance with the principles of the present invention has an upper surface layer and a lower underlying layer that is attached to at least a portion of a bottom of the upper surface. A fiber is preferably used for the upper surface layer and a bottom portion of the fiber is attached to the lower underlying layer. The underlying layer preferably includes an elastomer, such as rubber or any other desired type of elastomer. If desired, the underlying layer can also include a more rigid type of material, for example, plastic. The underlying layer can be opaque or transparent to visible light. If the underlying layer is opaque a portion of each light is disposed in an opening that is provided in an upper portion of the underlying layer sufficient to permit at least some of the illumination emanating from the light, when the light is illuminated, to enter into an area that is disposed above the upper surface layer and into the material that is used to create the upper surface layer. If the underlying layer is opaque an upper portion of any of the lights may also extend, if desired, through the underlying layer and enter into an area above the underlying area where a lower portion of the material that is used for the upper surface layer is disposed. However, the upper portion of the lights are always disposed below an upper plane of the upper surface layer to prevent contact between the lights and the user (such as with the user's feet or shoes) from occurring. The underlying layer includes a battery (or batteries), wiring, at least one and, preferably, a plurality of lights, one or more desired sensors that are used to activate the doormat, and circuitry to actuate (energize) the plurality of lights whenever the doormat has been activated. When a person steps on, approaches, impacts, jars, or otherwise contacts the doormat (depending on the type of sensors that are used) one or more of the sensors is actuated and, accordingly, activates the doormat by supplying electrical energy from the battery to the circuitry and, accordingly, to the lights, which are then illuminated. According to a first embodiment the lights will remain illuminated until the moment that the person steps off or otherwise ends contact with the doormat. According to a second embodiment at the time that the doormat is activated and the lights are illuminated a timer is also activated. This occurs when any sensor is initially actuated. The timer counts for a predetermined period of time that is equal to the duration of the timer, during which time the lights remain illuminated. The predetermined period of time, if desired, is selectable or it can be fixed. When the timer determines that the predetermined period of time has elapsed the lights and most or all of circuitry are turned off (de-energized) until at such time when at least one of the sensors is are actuated and the cycle is, again, repeated. If it is desired that any operating parameter of the doormat is selectable by the user, one or more switches may be included to establish the variable input or inputs that the circuitry uses to vary and control any desired operational parameter of the doormat that is variable. If desired, a microcomputer is included with the circuitry along with ROM and/or, if desired, RAM. An electrical connection can be included as a port for inputting digital data into the RAM, as desired. The digital data can be used to establish the variable input parameters and/or used to provide upgrade capability for the software.

DETAILED DESCRIPTION OF THE INVENTION

Figure 1:
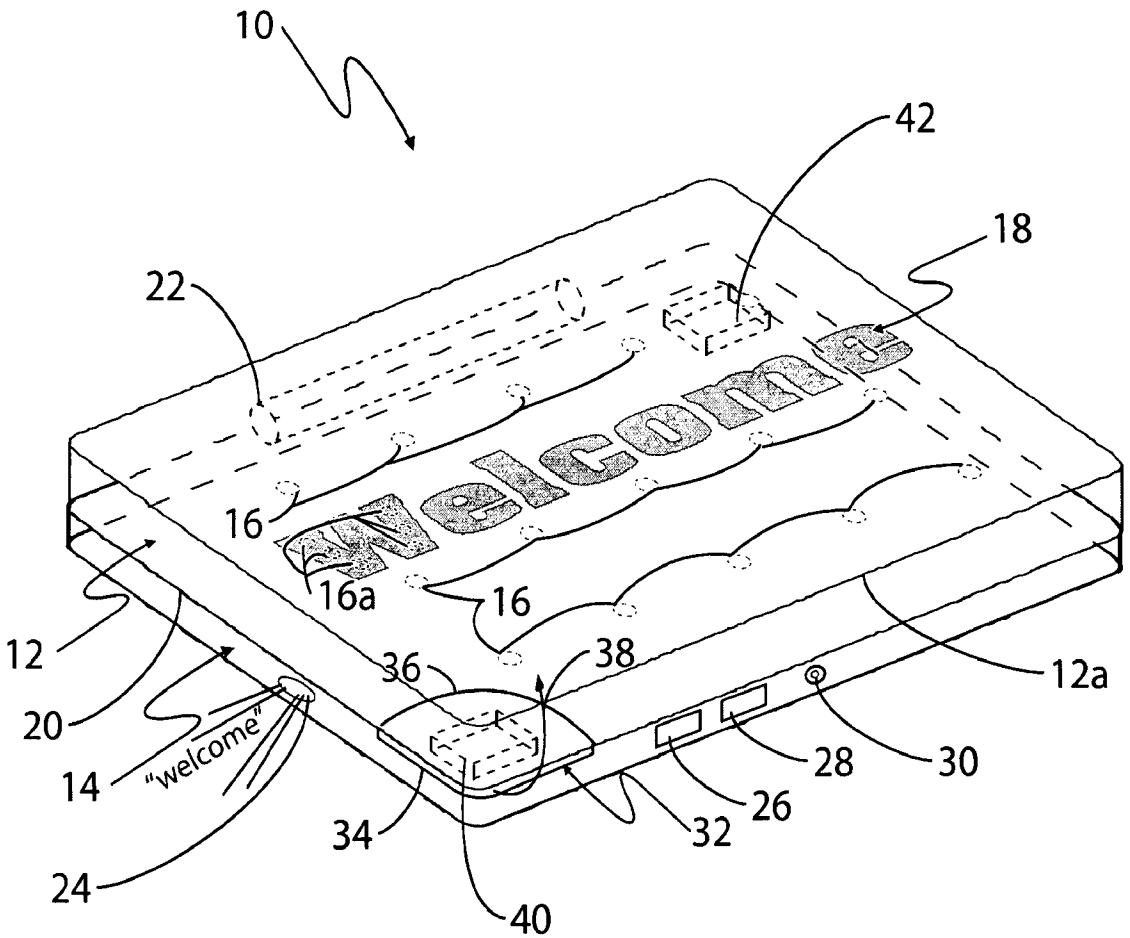
FIG. 1 is a view in perspective of a basic embodiment of an illuminated doormat.

Referring initially to FIG. 1 and, as necessary, on occasion to all of the drawing figures is shown, an illuminated doormat, identified in general by the reference numeral 10.

The illuminated doormat 10 includes an upper surface layer, identified in general by the reference numeral 12 that is disposed over and attached to at least a portion of a lower underlying layer, identified in general by the reference numeral 14.

The following description details construction of a preferred embodiment of the illuminated doormat 10 when the upper surface layer 12 includes a fiber, such as coconut fiber, or another type of fiber, fibrous, threaded, or woven material, and when the lower underlying layer 14 is formed of an elastomeric type of material that is generally opaque to visible light.

When coconut fiber is used to form what would be the general equivalent of the upper surface layer 12 of the illuminated doormat 10 to produce a conventional prior art type of a doormat (not shown) the prior art doormat is sometimes referred to as a "coir" mat. Accordingly, if coconut fiber is used to form the upper surface layer 12 of the illuminated doormat 10, the illuminated doormat 10 could similarly be referred to as a type of an illuminated coir mat.

Rubber that is recycled has commonly been used to form a bottom layer of a prior art type of doormat (not shown) that includes a coir (coconut fiber), fabric, or woven type of upper surface. Similarly, rubber (whether recycled or not) as well as any other preferred type of elastomer is especially well suited to form the lower underlying layer 14 of the illuminated doormat 10. The underlying layer 14 can also be formed of more rigid types of material including, for example, certain types of plastic, if desired.

The fiber (coir) or material used to form the upper surface layer 12 includes an upper portion and a lower portion. The upper portion of the material used to form the upper surface layer 12 forms an upper plane 12*a* of the upper surface layer 12 that is generally planar and which is stepped on during use. It can also used to clean the bottom of the shoes. The lower portion of the material (fiber or otherwise) that is used to form the upper surface layer 12 is generally embedded in the rubber (or in any other type of elastomer or other type of more rigid material used to form the underlying layer 14). Accordingly, the fiber or other material of the upper surface layer 12 is secured together to provide the upper surface layer 12.

A variation in construction is also possible regarding placement of the lights 16, 16*a* when the lower underlying layer 14 that is used with the illuminated doormat 10 is formed of a material that is transparent to visible light, whether the lower underlying layer 14 is formed of an elastomeric or a more rigid type of material, and regardless of the type of material that is used for the upper surface layer 12 of the illuminated doormat 10.

If desired, the upper surface layer 12 can include a section of carpet of any desired type or other type of suitable material that has been sized appropriately to correspond with the size of the lower underlying layer 14 and, after having had benefit of the disclosure herein, any reasonably skilled person in the art would be able to substitute and use the section of carpet as the upper surface layer 12.

A plurality of lights 16 are disposed where desired under the upper plane 12*a* of the upper surface layer 12. The plurality of lights 16, when illuminated, provide general illumination to the area that is disposed above and proximate the illuminated doormat 10, making it easy to locate and properly orient a desired entry key and insert key into the key opening of a door lock (not shown). Furthermore, the illumination is only provided when it is actually needed for this purpose, as described in greater detail hereinafter.

The plurality of lights 16, when illuminated, also illuminate the upper surface layer 12 and the upper plane 12*a* to brighten the appearance of the illuminated doormat 10 and add to its aesthetic appeal. By illuminating the upper plane 12*a*, any ornamental design or text that is included (i.e., imprinted) on the illuminated doormat 10 is also accentuated by the plurality of lights 16, when illuminated. This is further discussed, below.

The degree or brightness of illumination provided by the illuminated doormat 10 can be varied in a number of ways depending on how the illuminated doormat 10 is manufactured and whether or not user-selectable control capability (i.e., switch settings or programmable control) of the lights 16, 16*a* is provided with any particular version of the illuminated doormat 10.

Figure 2:
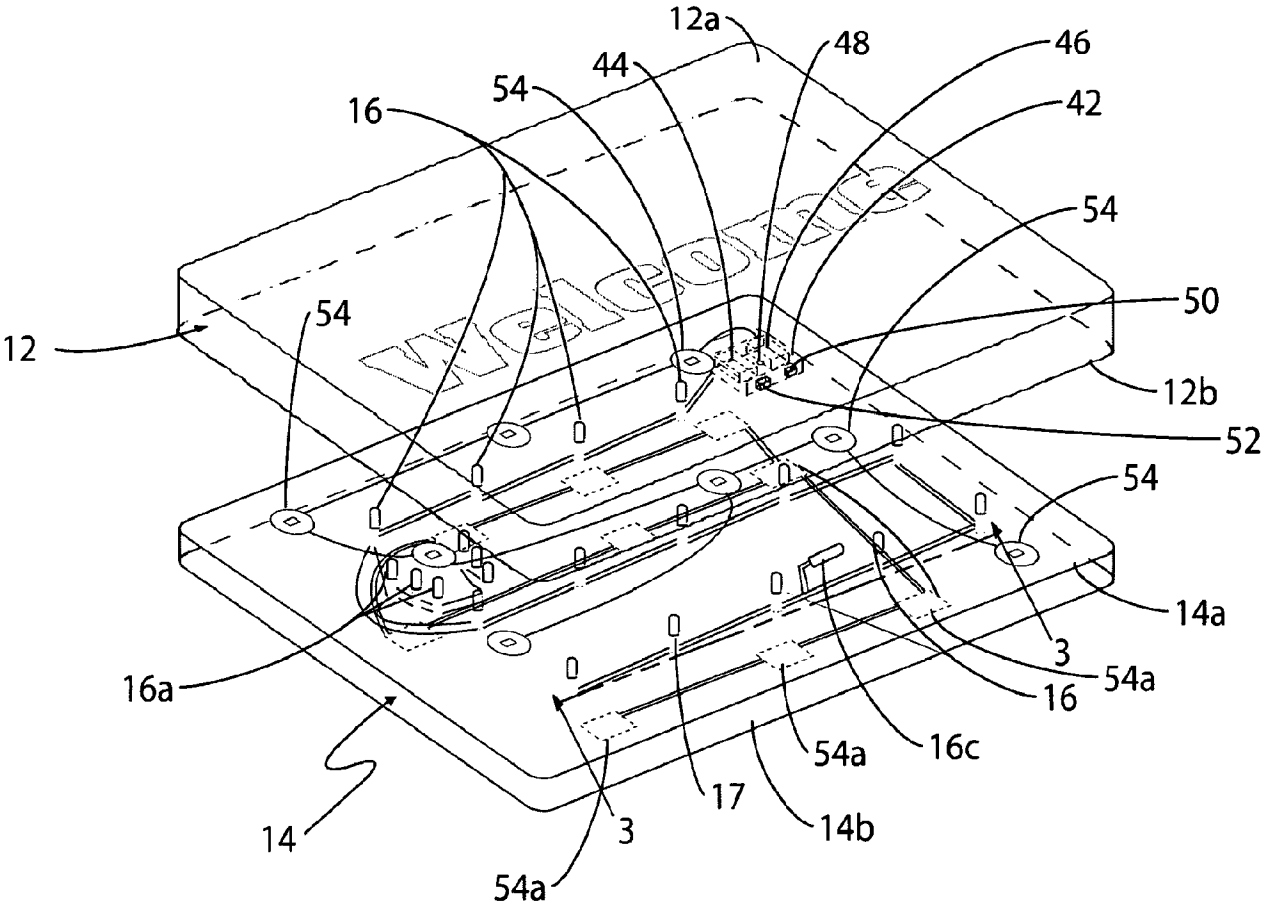
FIG. 2 is a view in perspective of a light panel of the illuminated doormat of FIG. 1 and which also shows in exploded view, an upper surface layer that is disposed above an underlying layer.

For example, the type, number, and placement of the plurality of lights 16 can be varied during manufacture, depending on the capabilities and attributes that are desired for any given version of the illuminated doormat 10. As described in greater detail hereinafter, the lights 16 can be disposed vertically (as shown in FIG. 2) so that an upper portion of any of the lights 16 extends a predetermined distance above an upper plane surface 14*a* (see FIG. 2) of the lower underlying layer 14. The upper portion of the lights 16 would then pass through a bottom plane 12*b* of the upper surface layer 12 and enter into a lower portion of the upper surface layer 12.

If desired, some or all of the lights 16, 16*a* could be disposed and recessed in individual openings 17 (only one individual opening 17 is shown in FIG. 2) provided in the underlying layer 14. When illuminated, light from the lights 16, 16*a* would pass upward through the individual openings 17 to illuminate the upper surface layer 12 and the area disposed above the upper surface layer 12.

Alternately, the lights 16, 16*a* (some or all of them) can instead be disposed entirely below the upper surface layer 12 if the underlying layer 14 is sufficiently transparent to visible light without the need for the individual openings 17s to convey light upward and out from the underlying layer 14. The lights 16, 16*a* would then be disposed where desired in the underlying layer 14 and, preferably, in as close to a horizontal attitude (parallel with the plane of the underlying layer 14) as possible to minimize the required thickness of the underlying layer 14.

If the lights 16, 16*a* are disposed entirely in the underlying layer 14 they can be molded in place during manufacture of the illuminated doormat 10 or they can be disposed in accessible open areas (for example, in corresponding recesses that are provided in the top upper plane surface 14*a* of the underlying layer 14; see patent application Ser. No. 12/290,360 incorporated herein by reference) that are provided in the underlying layer 14.

An optional object or message, identified in general by the reference numeral 18, is imprinted on the upper plane 12*a*. The object or message 18 can include any preferred ornamental design, text, or image of a person or caricature, whether real or imagined, including those that may be appear or be created for use in the movies or elsewhere.

If desired, a plurality of strategically placed visual augmentation lights 16*a* are used to augment the object or message 18, when illuminated, as well as to provide general illumination to the area that is disposed above and proximate the illuminated doormat 10 in a manner similar to that described above for the plurality of lights 16. As shown, the strategically placed lights 16*a* align underneath the letter "W" and thereby enhance visibility of the "W" when illuminated. Additional strategically placed lights 16*a*, not shown, can be included and placed where desired, for example under the remaining letters of the word, "Welcome" which is used herein to illustrate but one possible example of an infinite variety of words or instructions that can be used as the object or message 18. The object or message 18 could include an instruction, such as, "Use the backdoor for deliveries" (not shown).

Light emitting diodes (LEDS) are preferred for use as the lights 16 or as the strategically placed lights 16*a* and while any color of LED can be used, white is generally most preferred for its illumination value. LEDS draw very little electrical power in proportion to the illumination produced and they are rugged and have a very long life expectancy, typically, lasting several tens of thousands of hours. For normal use of the illuminated doormat 10, the LEDS will last a lifetime, as they are only illuminated intermittently, as is described in greater detail, hereinafter.

While the preferred embodiment, as herein described, illuminates all of the lights 16, 16*a* simultaneously and turns them all off simultaneously, it is anticipated that other versions of the illuminated doormat 10 can be set to turn on the lights 16, 16*a* in novel ways. For example, the lights 16, 16*a* could be illuminated (i.e., turned on) and turned off in a desired sequence. If included with the illuminated doormat, this could create a sense of motion or movement.

It is expected that the illuminated doormat 10 will be offered in different styles, appearances, and in versions of varying capability. For example, the most basic version likely to be offered will include the fewest lights 16, 16*a* that are deemed necessary and with no user-controllable inputs. If desired, the batteries used to illuminate the most basic version or other more basic versions of the illuminated doormat 10 may be embedded in the lower underlying layer 14 during manufacture and not be replaceable by the user. Rather, when the batteries eventually fail for this type of a very basic version of the illuminated doormat 10 it will no longer produce illumination although, if desired, it may still be used as a conventional (non-illuminated) type of a doormat (not shown). The most basic or more basic versions are discussed in greater detail hereinafter. If desired, each or certain of the lights 16, 16*a* can include multi-color capability (as is available with certain LEDS) and they can be set to turn on and off in any desired sequence and, when illuminated, they can be set to switch between available colors in any preferred sequence.

Accordingly, the illuminated doormat 10 can be designed to provide a wide range of novel illumination presentations. This can provide additional advantage for seasonal or holiday use and for commercial applications.

A boundary line 20 between the upper surface layer 12 and the lower underlying layer 14 extends around the perimeter of the illuminated doormat 10.

There are many variations in design that are possible for the illuminated doormat 10 and only a few are described, herein, to illustrate some of the design variability. For example, the specification describes and illustrates various locations for placement of certain component parts (such as various battery compartment locations). Depending on design preferences, the type, number, and location of most of the component parts of the illuminated doormat 10 can be varied to suit. It is, of course, to be understood that even though numerous possible locations are shown for the battery compartment (and other component parts) only one battery compartment (or other desired component part) will typically be included with the illuminated doormat 10 and it will be located where desired for that particular version.

If desired, the illuminated doormat 10 can even be customized or personalized, for example, to provide unique or personalized lighting characteristics and capabilities by enhanced illumination control of the lights 16, 16*a*, by the use of custom or personalized ornamental designs, or by including custom or personalized text or quantity, type and placement of the lights 16, 16*a*, thereon.

An optional exterior container 22 is attached to the illuminated doormat 10 at a rear, thereof, or at any other preferred side along a perimeter of the illuminated doormat 10. If the exterior container 22 is included, it would minimally include one or more batteries that supply electrical power to the illuminated doormat 10. If the exterior container 22 is included it can also optionally include switches for controlling any variable operating parameter of the illuminated doormat 10, or any desired electrical or electronic component, including a microcomputer, ROM or RAM, or it can include any desired type of an electrical connector, for example an electrical connector that may be used to connect an external cable to and download digital data for use as variable operating parameter information or for use as software upgrades to the control circuitry or operating system of the illuminated doormat 10.

An optional speaker 24 is included when it is desired that the illuminated doormat 10 also provide an audible announcement, such as that used for the object or message 18. If the optional speaker 24 is included and enabled for operation (it is also desirable to be able to disable the speaker 24 from operation, as desired, to suit individual preferences) the object or message 18 or, alternately, an audible message other than that of the object or message 18 is recited through the speaker 24, preferably at the same time when the illuminated doormat 10 is activated and the lights 16, 16*a* are initially illuminated.

The audible message, if this capability is desired, is stored on any preferred media, including digital or non-digital types of media that can be included with the illuminated doormat 10. The ability to store and recite the audible message over the speaker 24 by any preferred method can be included by one possessing ordinary skill in the art after having read and studied the instant disclosure and the patent application that is incorporated by reference, herein.

If desired, access to the batteries can be provided by a side-mounted battery access cover 26 that is opened or removed to provide access to a battery compartment that is disposed in the lower underlying layer 14.

If desired, access to a grouping of switches (such as standard DIP-type switches) and/or to removable or replaceable ROM or RAM (including memory that includes a representation of the audible message) can be provided by a side-mounted switch access cover 28 that is opened or removed to provide access to a switch and/or ROM or RAM compartment that is disposed in the lower underlying layer 14.

If desired, a side-mounted electrical connector 30 is included in the lower underlying layer 14. The connector 30 may include a protective covering is opened or removed to provide access to the connector 30 by a compatible electrical plug (not shown) at an exterior of the illuminated doormat 10. Digital data is downloaded through the connector 30 and is used as variable operating parameter information to control any operating parameter of the illuminated doormat 10 or to download software upgrades to improve, repair software errors, modify or customize the control circuitry or operating system of the illuminated doormat 10.

Also, if desired, a corner location of the illuminated doormat 10 can include a section, identified by the reference numeral 32, of the lower underlying layer 14 that is severed along an exterior line 34 and extending inward into the lower underlying layer 14 up to a dashed line 36. A corner of the section 32 can be grasped and raised in the direction of arrow 38 to provide a location for an internal compartment 40 (dashed lines) that is used to contain one or more batteries and/or an internal grouping of switches and/or an internal connector, as well as to provide access thereto, providing, of course, that the lower underlying layer 14 is formed of a sufficiently flexible (i.e., elastomeric) material.

The internal switches and the internal connector function as previously described for the switches that, if included, are disposed under the side-mounted switch access cover 28 and the side-mounted electrical connector 30. The side-mounted battery access cover 26, the side-mounted switch access cover 28, and the side-mounted electrical connector 30 are, of course, not included if internally disposed batteries are included and disposed in the internal compartment 40 is provided and the internal switches and the internal connector are included in the internal compartment 40 and if they are even required for inclusion in the version of the illuminated doormat 10 that is being produced. For example, as previously mentioned, a basic version of the illuminated doormat may include batteries that are not replaceable but which are expected to provide a sufficient useful life expectancy, for example, at least one year of normal use. It is also possible to include rechargeable batteries, if desired, that can periodically be recharged by any preferred method including solar.

If desired, a bottom-accessible compartment 42 (or a plurality of bottom-accessible compartments) is/are provided in the lower underlying layer 14 and are disposed therein so that a cover of the bottom-accessible compartment 42 (or compartments) is even with a bottom plane of the lower underlying layer 14. To replace the batteries, change the switch settings, or connect an external plug (and cable) to the illuminated doormat 10, the illuminated doormat 10 is inverted and a cover (or covers) of the bottom-accessible compartment(s) 42 is/are opened or removed.

As shown in FIG. 2, the bottom-accessible compartment can be used to house the batteries, identified in FIG. 2 by reference numeral 44, an array of switches 46, an internally-mounted electrical connector 48, a removable memory device 50 and, as required, an electronic circuit 52 to operate the illuminated doormat 10. Any of several components of the preferred embodiment can be eliminated from the illuminated doormat 10 for more basic versions, including the speaker 24, the switches 46, the connector 48, the memory device 50, and other components.

For more basic versions, the circuit 52 can be configured to include only simple interconnecting wiring that uses any desired type of sensor (see below) to function as an on-off type of switch that turns the lights 16, 16*a* on when the sensor is activated (i.e., when a switch in the sensor is closed) and off when the sensor is deactivated (i.e., when the switch in the sensor is open, as it normally would be when the illuminated doormat 10 is in a quiescent or "off" state).

To illustrate a basic version, any preferred type or number of pressure activated switches 54 are preferably included with the illuminated doormat 10. As shown, they are placed primarily within the underlying layer 14 or so that an active surface of the pressure activated switches 54 is disposed even with or slightly above the upper plane surface 14*a* and are wired in parallel. Typically, the pressure activated switches 54 are a type of normally open switch that is closed when a weight is disposed over it which occurs when a person of sufficient weight steps on the illuminated doormat 10.

If wired in parallel (and connected with the battery 44 and the lights 16, 16*a*) when any one or more of the pressure activated switches 54 are closed, electrical continuity of a simple version of the circuit 52 is completed that supplies electrical power to the lights 16, 16*a* from the battery 44 (or batteries) whenever the person is disposed on the illuminated doormat 10. The moment the person steps off of the illuminated doormat 10 all of the pressure switches 54 that were electrically closed open and the circuit 52 then ceases to supply electrical power to the lights 16, 16*a*. Accordingly, the lights 16, 16*a* are illuminated only when the person is standing on the illuminated doormat 10.

This provides several significant benefits. It allows the use of smaller capacity and/or fewer of the batteries 44 because the duty cycle (on time) of the lights 16, 16*a* is very low. If desired, thin or "pancake" types of the batteries 44 can be used. If desired, the batteries 44 can include conventional sizes, such as AA, AAA or other sizes. If the exterior container 22 is used instead of the bottom-accessible compartment 42, a convenient place for larger sizes or for a greater number of the batteries 44 is provided.

Also, if a stray wild animal or pet should step on the illuminated doormat 10, such as during the night, the animal or pet likely will not weigh enough to activate any of the pressure switches 54. Accordingly, unwanted illumination of the lights 16, 16*a* will not occur.

The lights 16, 16*a* may be wired in series or parallel, depending on the available voltage and other considerations. Typically, a resistor (not shown) is provided in series to limit current through the lights 16, 16*a* when the lights 16, 16*a* include LEDS. Design and desired modification of the circuit 52 (from the most simple version to the most feature-capable microprocessor controlled version) could be easily accomplished by those (i.e., electrical engineer and/or microcomputer programmer) having ordinary skill in the art after having had benefit of this disclosure.

The use of small or thin batteries 44 allows for very thin construction of the underlying layer 14, which is usually preferred because when the underlying layer 14 is thin it provides a low overall height for the illuminated doormat 10 that is comparable to that of a conventional non-illuminated prior-art type of doormat (not shown).

The pressure activated switches 54 are placed where desired on the underlying layer 14. The goal is to ensure that at least one of the pressure activated switches 54 will be activated (i.e., electrically closed) when a user steps anywhere on the upper surface 12 that is disposed over the underlying layer 14.

If desired, the pressure activated switches 54 can each be placed in a corresponding recessed area that is provided in the lower underlying layer 14 proximate the upper plane surface 14*a*. Each recessed area would properly orient each of the pressure activated switches 54 and also maintain each of the pressure activated switches 54 so that an upper and activating portion of each of the pressure activated switches 54 is disposed where desired, preferably equal to or above the upper plane surface 14*a*.

If desired, the pressure activated switches 54 can be eliminated and a plurality of inverted pressure activated switches 54*a* (only two are shown, however as many are used as desired) are included proximate a lower underlying plane 14*b* of the underlying layer 14. If desired, the inverted pressure activated switches 54*a* can be disposed so that an activating switch portion of each is disposed slightly below the lower underlying plane 14*b* to help ensure that at least one of the inverted pressure activated switches 54*a* will be activated (i.e., the switch therein will be closed) when the person steps on the illuminated doormat 10.

It is also possible to use other means for activating the illuminated doormat 10 (i.e., to turn it on) other than the pressure activated switches 54, 54*a* or in addition with them. For example, one or more inertial types of sensors that are able to detect a change in movement can be used if desired to detect changes in inertia or any acceleration that may occur to the illuminated doormat 10 if it is jarred shoved, kicked, or otherwise moved from a rest position. Alternately, any type of a motion sensor that detects the approach of another person could also be used providing that it draws a minimal amount of electrical power.

For new construction of the illuminated doormat 10 it is preferred to mold and include the component parts in the underlying layer 14 and, if desired, to have the lights 16, 16*a* protrude slightly above the upper surface plane 14*a* and enter into the bottom area of the upper surface layer 12 during manufacture, thereby manufacturing the illuminated doormat 10 as an integral piece.

New construction in this manner provides several benefits. The overall thickness of the illuminated doormat 10 can be kept as thin as possible for new construction, which is desirable. Also, new construction provides the greatest range of options as to where to mount the various components, for example, the battery compartment and batteries and, if included, speaker, switches, or the digital interface connector (i.e., port), etc.

Another significant benefit provided (for new one-piece construction or for use with existing prior art doormats) is that most elastomers are also excellent dielectrics (insulators). Therefore, when an elastomer is used for the lower underlying layer 14 it is not a requirement that the wires that interconnect the lights 16, 16*a* with the control circuitry and with the wires that interconnect all of the sensors (i.e., the pressure activated switches 54, 54*a* or other types of sensors) with the control circuitry include insulation around the conductors. Bare wires, if kept separated during manufacture of the underlying layer 14, can be used and will be surrounded by the insulating elastomer after construction of the underlying layer 14 is complete. This provides an important, yet unexpected, benefit of simplifying and reducing the cost of manufacture.

However, in order to avoid having to modify existing manufacturing processes or equipment that produce a prior art type of doormat, it is possible to adapt for use with the illuminated doormat 10, currently manufactured versions of the prior art type of doormat. The prior art doormat would then be an assembly component of the illuminated doormat 10. When using a prior art doormat as a component, the underlying layer 14 is seen as including an upper portion and a lower portion, thereof. The upper portion of the underlying layer 14 is included with the prior art doormat as a lower layer of the prior art doormat to which the fiber or fabric that forms the upper surface layer 12 (of the prior art doormat) is attached. The lower portion of the underlying layer 14 is separately produced and attached to the prior art type of doormat. The lower portion of the underlying area 14 is as shown in FIG. 2, although it is preferable that it be kept as thin as possible and it would include all of component parts and wiring that are to be included in the desired version of the illuminated doormat 10.

The lights 16, 16*a* would preferably include LEDS and would be vertically oriented as shown. The prior art types doormats can be formed of coir or any other type of fiber, including threaded or woven types of doormats and they typically include a thin rubber opaque elastomeric bottom layer to which the coconut and other types of fibers that form the upper surface layer 12 (of the prior art doormat) are already attached.

The lights 16, 16*a* are disposed where desired and oriented upward. Holes are then provided (drilled) through the elastomeric bottom layer of the prior art type of doormats that align with the positioning of the lights 16, 16*a* of the modified type of the underlying layer 14. An adhesive is applied to the upper plane surface 14*a* and the prior art doormat is placed so the elastomeric bottom layer of the prior art doormat is disposed over the underlying layer 14, urging the prior art doormat downward, while ensuring that all of the lights 16, 16*a* align with the respective holes that have been provided through the elastomeric bottom layer of the prior art doormat. The prior art doormat is urged downward as far as it will go until it is in contact with the upper plane surface 14*a* and adhered thereto. The lights 16, 16*a* pass through the elastomeric bottom layer of the prior art doormat, enter into, and extend up into the fiber, threaded, or woven upper surface layer 12 portion of the prior art doormat a desired amount that allows for a sufficient amount of illumination to pass through the upper surface layer 12 of the prior art doormat and illuminate the area above the prior art doormat. In this way, existing types of prior art doormats can be used to form variations of the illuminated doormat 10.

Once adhered, the manufactured unit that includes the prior art doormat is similar to the newly manufactured version of the illuminated doormat 10. When the illuminated doormat 10 is manufactured using a prior art doormat as a component thereof, is preferable to adhere the corner section 32 of the lower underlying layer 14 to the prior art doormat and utilize the internal compartment 40 and corner lifting approach to providing access to the batteries 44, etc.

Whether entirely new construction or if a prior art type of doormat is included as a component of the illuminated doormat 10, care is always taken to ensure that no portion of the lights 16, 16*a* protrudes above the plane of the upper plane 12*a*. This is to prevent discomfort or abrasion to the soles of the feet of a user from occurring and also to prevent possible damage to the lights 16, 16*a* from occurring.

When a person steps on the upper plane 12*a* the material that is used to form the upper surface layer 12 compresses in proportion to the loading (i.e., pounds per square inch) that is being applied. For example, a lady wearing high heeled shoes may have a greater loading than a man who weighs considerably more. Depending on the material used to form the upper surface layer 12, the degree of compression that is likely to be experienced during normal use is calculated, and the placement of the uppermost tops of the lights 16, 16*a* is set so that it will not experience excessive loading during use of the illuminated doormat 10.

Therefore, the ideal vertical placement of the lights 16, 16*a*, when they extend above the upper plane surface 14*a* and through a lower plane 12*b* of the upper surface layer 12, is a balance between maximizing the amount of light emanation above the illuminated doormat 10 while protecting the lights 16, 16*a* from possible damage and the user from the possible discomfort or injury if contact with the lights 16, 16*a* were to occur during use (when stepping). It is useful to note that another unexpected benefit provided by the use of LEDS as the lights 16, 16*a* is that they do not include glass and are, therefore, especially rugged. Therefore, the LEDS can extend higher into the upper surface layer 12 than can other sources (types) of illumination that include glass, for example, than can any type of an incandescent bulb.

As previously mentioned, if desired a more rigid material such as plastic or other materials can be used to form the lower underlying layer 14. The more rigid underlying layer 14 can also can be formed of an opaque or clear (transparent to visible light) material and, depending on the light transmission properties of the material used to form the underlying layer 14, the mounting and positioning of the lights 16, 16*a* would be treated substantially the same with the more rigid types of the underlying layer 14 as they are when either a clear or an opaque elastomer is used for the underlying layer 14.

As desired, other versions of the illuminated doormat 10 include other components, features, and capabilities. For example, the circuit 52 can include any combination of analog and/or digital circuitry including a microcomputer and, if desired, a timer. Integrated circuit timers and microcomputers are known in the electronic arts and therefore design of the circuit 52 would be possible to one of ordinary skill after having had benefit of this disclosure.

When the timer is included and any of the sensors (54, 54*a*) are activated, power is supplied to the circuit 52 and the timer is activated. The lights 16, 16*a* are immediately illuminated and remain illuminated for the duration of the timer, and upon elapse of the timer, the lights 16, 16*a* are turned off and electrical power is removed from the circuit 52 until the illuminated doormat 10 is again stepped on or otherwise activated. The switch 46 is preferably included as a means for varying the duration of the timer. The timer is useful because the illumination remains active for the duration of the timer even if the person should step off of the illuminated doormat 10. This can facilitate the unlocking and opening of a door.

Additional capabilities of turning the lights 16, 16*a* on when the illuminated doormat 10 is activated and of turning the illuminated doormat 10 off if the person steps off of it and then back on it before the timer has elapsed but after passage of a minimum amount of time are also possible and the means for accomplishing this is described in the related prior art document that was included by reference.

Figure 3:
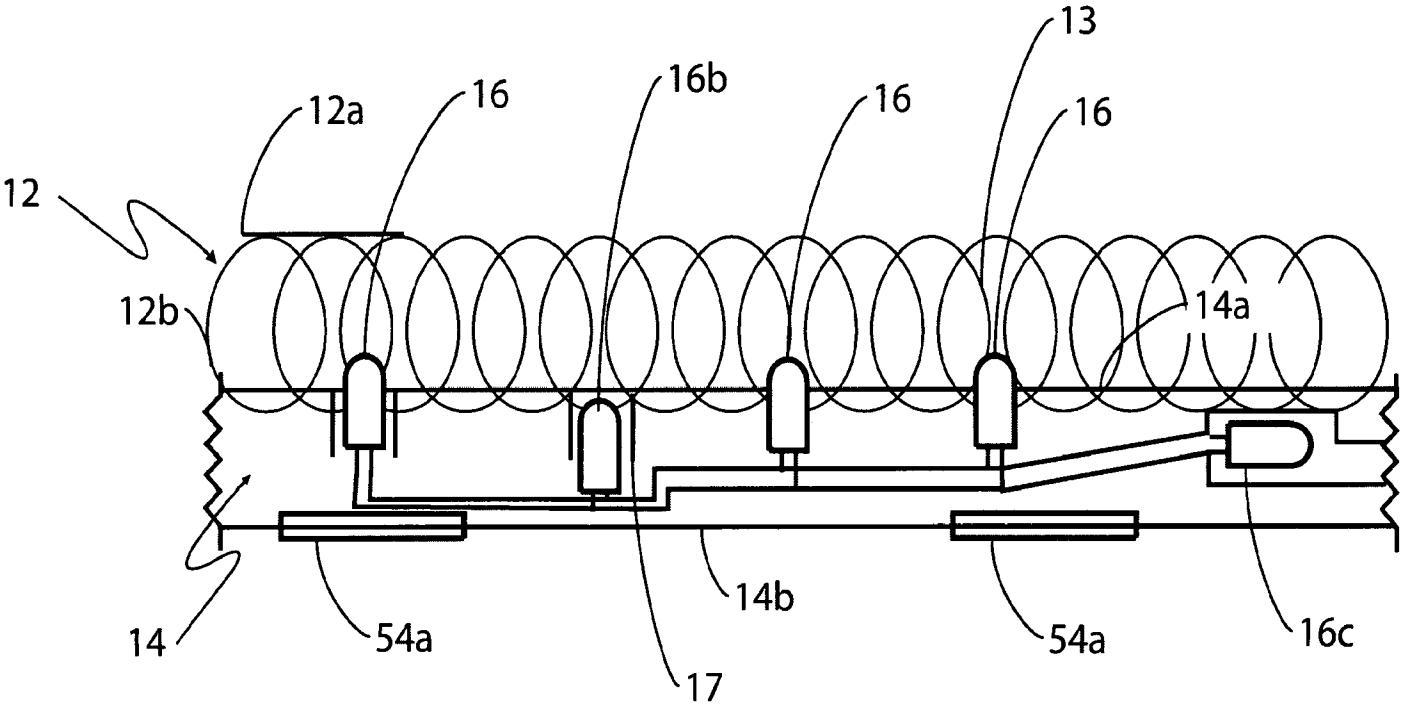
FIG. 3 is a cross sectional view taken on the line 3-3 in FIG. 2.

Referring also to FIG. 3, is shown in cross-section certain of the component parts of the illuminated doormat 10 and attachment of a surface material 13 (i.e., a coir or other type of fiber or threaded or woven material that is used to form the upper surface layer 12) to the underlying layer 14 by embedding (or adhering, if desired) the lower portion of the surface material 13 in or adhering it to the underlying layer 14. Also shown is placement of the lights 16, 16*a* so that an upper portion thereof protrudes above the upper plane surface 14*a* and into a lower portion of the surface material 13.

An alternate placement is also illustrated by a lower disposed light 16*b* that is disposed in the individual opening 17 in which the lower disposed light 16*b* does not extend above the upper plane surface 14*a* or enter into any of the surface material 13. Rather, illumination from the lower disposed light 16*b* emanates upward and out of the top of the individual opening 17 and into the surface material 13.

Additionally, a horizontal light 16*c* is included in the underlying layer 14 when the underlying layer 14 is sufficiently transparent to visible light so that the surface material 13 is able to receive illumination from the horizontal light 16*c*.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An illuminated doormat for use with at least one battery, comprising:

(a) an upper surface layer that includes a material suitable for stepping on;

(b) a lower underlying layer disposed below said upper surface;

(c) at least one light attached to said doormat;

(d) an area for housing said at least one battery;

(e) at least one sensor or pressure activated switch (f) a circuit for controlling said at least one light;

wherein said lower underlying layer is opaque to visible light, and means for conveying illumination from said at least one light to said upper surface layer when said at least one light is illuminated, and wherein said means for conveying illumination from said at least one light to said upper surface layer includes said at least one light attached to said lower underlying surface and wherein said at least one light is disposed in a vertical orientation and in an opening provided in said lower underlying layer, and wherein said opening extends at least to an upper plane of said lower underlying layer; and wherein, subsequent to an activation of said at least one sensor, said at least one light is illuminated, and wherein when said at least one light is illuminated, a portion of the light emitted from said at least one light is visible through said upper surface layer.

2. The illuminated doormat of claim 1 wherein said at least one sensor includes a pressure activated switch, and wherein said activation of said at least one sensor includes a closure of an electrical contact of said pressure activated switch, and wherein said closure affects an operation of said circuit.

3. The illuminated doormat of claim 2 wherein subsequent to said activation of said pressure activated switch electrical energy is supplied from said at least one battery to said circuit and to said at least one light, and said at least one light is illuminated until said pressure activated switch is not activated, and wherein when said pressure activated switch is not activated said electrical contact of said pressure activated switch is open.

4. The illuminated doormat of claim 2, wherein subsequent to said activation of said pressure activated switch, said at least one light is illuminated and electrical energy is supplied from said at least one battery to said circuit and to said at least one light.

5. The illuminated doormat of claim 4 wherein subsequent to said activation of said pressure activated switch, electrical energy is supplied through said circuit to a timer, and wherein said timer is initialized and then begins counting for a predetermined period of time, and wherein said circuit includes a latch or relay to maintain electrical energy to said circuit and said at least one light and said timer for said predetermined period of time, and wherein said at least one light is illuminated for said predetermined period of time regardless of a state of said pressure activated switch during said predetermined period of time and wherein, after said predetermined period of time has elapsed, said electrical energy is withdrawn from said circuit and from said timer and from said at least one light, and wherein said at least one light is not illuminated.

6. The illuminated doormat of claim 1 wherein said at least one light includes a plurality of lights.

7. The illuminated doormat of claim 1 wherein said at least one light includes at least one light emitting diode (LED).

8. The illuminated doormat of claim 1 wherein an upper portion of said at least one light extends above said opening and into a bottom portion of said upper surface layer.

9. The illuminated doormat of claim 1 wherein said lower underlying layer is sufficiently transparent to visible light.

10. The illuminated doormat of claim 9 wherein said at least one light is disposed in said lower underlying layer.

11. The illuminated doormat of claim 10 wherein said at least one light is disposed in a horizontal orientation.

12. The illuminated doormat of claim 1 wherein said circuit includes a microprocessor.

13. The illuminated doormat of claim 1 wherein said circuit includes at least one switch and wherein said at least one switch includes an input for controlling an operating parameter of said illuminated doormat.

14. The illuminated doormat of claim 1 wherein said circuit includes a message that is readable by said circuit and a speaker for playback of said message, and wherein upon said activation of said at least one sensor, said at least one light is illuminated and said message is played through said speaker.

15. The illuminated doormat of claim 1 wherein said upper surface layer includes a desired type of fiber, threaded, or woven material, and wherein a lower portion of said fiber, threaded, or woven material is attached to said lower underlying layer.

* * * * *